US005139012A

United States Patent [19]

Furman et al.

[11] Patent Number: 5,139,012

[45] Date of Patent: Aug. 18, 1992

[54] FIREPLACE HEAT EXCHANGER

[75] Inventors: Arthur J. Furman, Andover, Ohio; Timothy A. Grover, Cochranton, Pa.; Dennis C. Fielder, Danville, Va.; George J. Theodore, Strongsville; Ronald D. Sonedecker, Stow, both of Ohio

[73] Assignee: Cardinal American Corporation, Cleveland, Ohio

[21] Appl. No.: 605,248

[22] Filed: Oct. 29, 1990

[51] Int. Cl.[5] ..... F24B 7/00

[52] U.S. Cl. ..... 126/522; 126/524

[58] Field of Search ..... 126/521-524

[56] References Cited

U.S. PATENT DOCUMENTS

| | | | |
|---|---|---|---|
| 2,828,078 | 3/1958 | Snodgrass | 126/522 |
| 3,866,595 | 2/1975 | Jones | 126/521 |
| 3,930,490 | 1/1976 | Lassy et al. | 126/522 |
| 4,114,590 | 9/1978 | Frahm | 126/522 |
| 4,271,814 | 6/1981 | Lister | 126/521 |

FOREIGN PATENT DOCUMENTS

| | | | |
|---|---|---|---|
| 3316189 | 6/1984 | Fed. Rep. of Germany | 126/521 |

OTHER PUBLICATIONS

*The New and Improved Firebird Heat Reservoir Exchanger Model HR-200* (Article), Jun. 1980.

*Primary Examiner*—Allen J. Flanigan

*Attorney, Agent, or Firm*—Pearne, Gordon, McCoy & Granger

[57] ABSTRACT

A fireplace heat exchanger having input means that is directly connected to a blower assembly, air to be heated is drawn in by the blower assembly and forced directly through the input means into a heat reservoir that is suspended directly above or within the flame of the fireplace. The air is heated within the heat reservoir and then forced through an output means that includes a plurality of discharge ports through which the heated air is dispersed into a room. An aesthetically appealing manifold covers those portions of the input and output means that are outside the fireplace. That portion of the manifold that covers the output means includes a corresponding plurality of discharge ports through which the heated air is dispersed. The input and output means slidably fit within the input and output riser tubes so the heat exchanger can be adjusted for fireplaces of various depths. The heat exchanger can be used with fireplaces having a frame with closable doors, wire mesh curtains, or the like.

14 Claims, 2 Drawing Sheets

FIREPLACE HEAT EXCHANGER

BACKGROUND OF THE INVENTION

1. Field of the Invention

This invention relates generally to heat exchangers, and in particular to a forced air heat exchanger for use with a fireplace, wherein the heat exchanger forces room air through a heat reservoir located within the fireplace and recirculates heated air back into the room.

2. Description of the Prior Art

It is common for fireplaces to adorn rooms for aesthetic purposes, but it is even more common for fireplaces to be used as a means for heating those rooms. With the escalation of energy costs over the past two decades, many homeowners now rely upon fireplaces to augment their existing heating capabilities. While fireplaces do effectively contribute to the heating of homes and other buildings, it has long been known that they lose some heat though their chimneys. Also, the heat generated by the fire is not efficiently distributed throughout the room or rooms to be heated. Consequently, various heat exchangers have been developed to increase the heating efficiency of fireplaces.

Many contemporary fireplaces include a decorative frame insertable within the front of the fireplace. A set of glass doors, or a metal mesh curtain are often housed within the frame to prevent hot ashes from escaping the fireplaces. The glass doors also provide an aesthetic appeal to the fireplace. Further, when the glass doors are closed the rate of fireplaces burning can be better controlled. Thus, it may be advantageous to provide a fireplace heat exchanger that is compatible with closed glass doors.

One heat exchanger is disclosed in U.S. Pat. No. 4,074,681, issued to Whiteley on Feb. 21, 1978, that includes a U-shaped conduit placed flat on the floor of a fireplace and a fan that forces air from a room through the conduit. The inlet of the conduit is disposed on the opposite side of the fireplace as the outlet of the conduit. The heated air is subsequently exhausted back into the room. The center portion of the U-shaped conduit rests on the floor of the fireplace and the material to be burned is placed at least partially on top of the center portion. Thus, the center portion must be constructed of material capable of withstanding constant exposure to the hottest part of the fire, which increases the cost of construction. Also, prolonged exposure to such intense heat may cause the material to degenerate leading to possible repair or replacement.

Another heat exchanger is disclosed in U.S. Pat. No. 3,955,553, issued to Soeffker on May 11, 1976, that includes a forced air blower to provide a pressurized air flow through a plurality of laterally spaced tubes positioned within a fireplace. A manifold is connected to the blower that directs air into the tubes. The manifold is removable so that air can alternatively flow through the tubes by conversion. The heated air subsequently flows back into the room. The configuration of this heat exchanger does not lend itself for use with fireplaces having a frame, or a frame that houses glass doors. In particular, it would not be practically possible to use this heat exchanger with the glass doors closed.

U.S. Pat. No. 3,880,141, issued to Abshear on Apr. 29, 1975, discloses a heating system for fireplaces that positions a relatively flat heat exchanger at the rear of a fireplace. An air inlet duct is connected to the lower end of the heat exchanger and a hot air outlet duct is connected to the upper end. An electric pump or fan blows air from a room through the inlet duct, through the heat exchanger, through the hot air outlet duct, and back into the room. The cabinet and duct work of this heating system are rather cumbersome and not readily adaptable for use with contemporary fireplaces that typically include closable glass doors, or wire mesh curtains.

A previous design developed by the applicants includes an elongated manifold into which room air is initially forced by a variable speed motor. The manifold rests upon the hearth extension and acts as a conduit through which the air is forced. It is connected to the motor by a funnel shaped conduit. As air flows from the motor through the manifold, some of the air flows into an input conduit while some air is forced past the input conduit toward the center of the manifold. A block is located within and near the center of the manifold to prevent air from being forced through the length of the manifold. When air contacts the block it is redirected toward the input conduit so the air can flow through the input conduit and consequently a heat reservoir, in which the air is heated.

An extension segment is connected between the input conduit and a first riser tube that leads to the heat reservoir. Similarly, another extension segment is connected between a second riser tube and an output conduit. The heat reservoir is suspended above the fire by the first and second riser tubes. The extension segments allow the depth of the circulator to be adjusted.

The output conduit is connected to the opposite end of the manifold and guides the heated air from the second riser tube back into the manifold. When the heated air exits the output conduit, some of it backs up toward the block in the manifold while the rest is forced through the manifold and discharged into the room to be heated.

It has been discovered that certain aspects of the above mentioned design resulted in the heat exchanger operating inefficiently and that certain parts of the heat exchanger were susceptable to damage due to excess heat. In particular, the funnel shaped conduit between the motor and the manifold restricted air flow therebetween resulting in an inefficient flow volume. Also, with the block located near the center of the manifold, some air would travel past the input conduit to the block where the air would be forced to reverse its direction back toward the input conduit. Once the air returned to the input conduit it flowed into the input conduit. This air flow pattern caused the motor to work harder because of turbulence created near the entrance to the input conduit.

Also, the input and output conduits that connected the manifold with the extension segments restricted the air flow to and from the heat reservoir. This prevented an optimum air flow through the heat circulator and into the room being heated. It also allowed heated air flowing from the heat reservoir to accumulate in the second riser tube thereby becoming very hot resulting in potential damage to the tube leading to potential repair or replacement. Additionally, the separate extension segments between the riser tubes and the input and output conduits each had two joints which contributed to air loss into the fireplace thereby decreasing the heating capacity of the heat exchanger.

Further, it has been discovered that heated air was escaping from the manifold as it rested on the hearth extension. This decreased the efficiency of the heating unit because some of the air was escaping before it could be effectively forced into the room by the blower.

Thus, there still exists a need for fireplace heat exchangers that are relatively inexpensive to manufacture, easily installed within the fireplace, durable efficient, nd compatible with fireplaces that include frame having closable glass doors or wire mesh curtains.

SUMMARY OF THE INVENTION

Accordingly, it is an object of the present invention to provide an improved fireplace heat exchanger that overcomes the foregoing deficiencies. This is accomplished by providing a heat exchanger that creates an improved air flow pattern and minimizes air loss during circulating thereby achieving an increase in the heating efficiency of the heat exchanger. The heat circular is compatible with fireplaces having frames that house glass doors or wire mesh curtains.

A preferred embodiment of the present invention employs an input conduit having one end directly coupled with a blower assembly to guide cooler room air directly into an input riser tube. The blower assembly draws room air into the input conduit and forces the air through the heat exchanger where it is subsequently exhausted back into the room. The direct coupling between the input conduit and the blower assembly is employed advantageously over applicant's prior design because the previous funnel shaped conduit is eliminated thereby increasing air flow through the heat circular. Also, the turbulence in the manifold of the previous design is eliminated because the air flows directly through the input conduit into the input riser tube.

The input riser tube is directly joined to a heat reservoir in which the inputed air sustains an increase in temperature. Once heated, the heated air is forced through an output riser tube that is coupled with an output conduit that discharges the heated air into a room.

Both the input and output conduits includes a flattened section so thay can be overlaid with a decorative panel that rests on the fireplace hearth extension. The flattened sections lay on the hearth extension so they are substantially parallel with the front of the fireplace. The present invention employs the low profile of the flattened sections advantageously so that the glass doors of the fireplace may be opened and closed with the panel in place.

The output conduit includes a plurality of ports that align with a corresponding plurality of ports in the panel. The heated air flows from the output riser tube to the output conduit and is evenly exhausted into a room through the ports. It has been discovered that an optimum volume of air flow is obtained with the input and output riser tubes having an outside diameter of about two inches, the heat reservoir having an inside diameter of about four inches, the output conduit having five discharge ports, and the blower assembly pumping approximately 50 cubic feet of air per minute through the heat circulator.

The director discharge of the heated air through the output conduit, rather than through the extension segments and manifold as was done in applicant's previous design, eliminates the backup of heated air which was created by the prior design. Consequently, the likelihood of the output riser tube or conduit becoming overheated, thereby causing them to experience fatigue that often leads to repair or replacement, is substantially reduced.

Also, because the heated air is discharged directly from a output conduit rather than through the manifold the air isn't given an opportunity to escape from the manifold as it did with applicant's previous design.

The input and output riser tubes are connected to the input and output conduits, respectively, in a telescoping manner so they can be adjusted to fit fireplaces of various depths. This is accomplished by providing one end of the input and output conduits with a smaller diameter than the riser tubes so they can be adjusted in sliding relation. Each telescoping connection is a single joint that helps minimize the loss of heated air into the fireplace. This is another advantage over applicant's prior design that used a separate piece of conduit having two joints resulting in heated air being lost to the chimney. The present telescoping design is also earier to manipulate.

A preferred embodiment of the present invention is compatible with fireplaces having frames that house glass doors or wire mesh curtains. The panel is designed so that the frame of a set of doors or wire mesh curtains can rest thereon. Thus, the present invention can be used with the fireplace doors or wire mesh curtains either open or closed.

DETAILED DESCRIPTION OF THE PREFERRED EMBODIMENT

Figure 1:
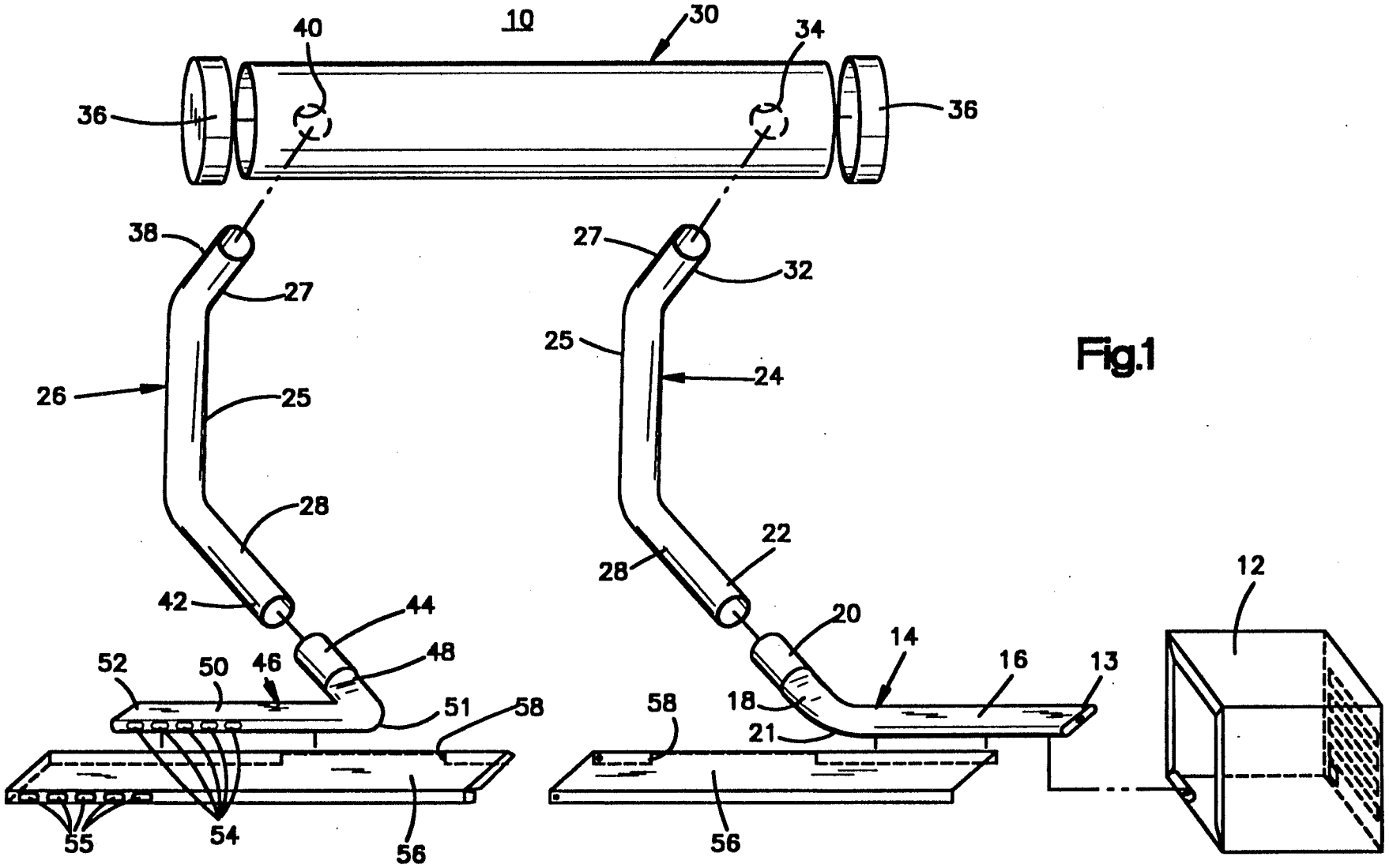
FIG. 1 is a first exploded perspective view of a preferred embodiment of the invention.

Referring now to the drawings, and in particular to FIG. 1, there is shown a fireplace heat exchanger according to the present invention 10. When assembled, a blower assembly 12 is coupled directly to the input end 13 of an input conduit 14. The blower assembly 12 is any conventional type, preferably having a single speed motor with a pumping capacity of 50 CFM (cubic feet per minute), but other motors of appropriate capacities could be used. The input conduit 14 preferably includes a flattened section 16, an cylindrical mid-section 18, and a stepped section 20 having a larger diameter than the cylindrical mid-section 18. The flattened section 16 includes an elbow portion 21 having a centerline radius of approximately 4 inches so that most of the flattened section 16 is substantially perpendicular to the stepped section 20.

The stepped section 20 has an appropriately sized outside diameter, preferably between about 1.84 and 1.85 inches, so it fits snugly within the lower end 22 of an input riser tube 24. A snug fit is preferred to minimize air loss during operation of the heat circulator. The stepped section 20 is about 3.25 inches in length and can slide back and forth within the lower end 22 to adjust the depth of the heat exchanger 10 within a fireplace. The depth can be adjusted between about 17 inches and 24 inches.

The input riser tube 24 and output riser tube 26 each have an overall height of about 31.25 inches. The riser tubes 24, 26 are shaped to occupy a minimal amount of usable space within the fireplace. Also, fuel to be burned can rest on or between the lower legs 28 which lay substantially flat on the fireplace floor. A mid-section 25 of each riser tube 24, 26 extends substantially vertical from the legs 28. An upper section 27 of each riser tube 24, 26 extends at an angle of about 45° from the mid-section 25 to suspend the heat reservoir 30 within or directly above the flame. The input and output riser tubes 24, 26 are preferably made of 16 gage steel and have an outside diameter of approximately two inches.

The upper end 32 of the input riser tube 24 is inserted within an aperture 34 of the heat reservoir 30. The upper end 32 is joined in a substantially air-tight manner, such as with appropriate screws and brackets, to minimize the loss of circulating air. The heat reservoir 30 is preferably made of 16 gage steel having an inside diameter of approximately four inches and a length of about 21 inches. The heat reservoir 30 includes end caps 36 that are secured in a substantially air-tight manner to the ends of the heat reservoir 30. The end caps 36 are secured in any conventional manner, such as by an interference fit. The end caps 36 are preferably constucted of 20 gage steel having inside diameters of about four inches when attached.

The upper end 38 of the ouput riser tube 26 is inserted within an aperture 40 of the heat reservoir 30. The upper end 38 is joined to the heat reservoir 30 in a substantially air-tight manner, such as with appropriate screws and brackets. The lower end 42 of the output riser tube 26 is placed over a stepped section 44 of an output conduit 46. The stepped section 44 has an appropriately sized outside diameter, preferably between about 1.84 and 1.85 inches, so it fits snugly within the lower end 42. A substantially air-tight fit is preferred to minimize the loss of heated air during operation of the heat circulator. The stepped section 44 is slidable within the lower end 42 to adjust the depth between about 17 inches and 24 inches.

The output conduit 46 includes an cylindrical mid-section 48 having a reduced diameter relative to the stepped section 44. A flattened section 50 is connected to the mid-section 48 and includes an elbow portion 51 having a centerline radius of approximately four inches so that a substantial portion of the flattened section 50 is perpendicular to the stepped section 44. The discharge end 52 of the output conduit 46 includes a plurality of discharge ports 54 through which the heated air is discharged. There are preferably five discharge ports 54 to maximize the discharge efficiency of the heat circulator and attain an even distribution of heated air into the room.

Preferably, each discharge port 54 is substantially rectangular with its ends defined by a radious of curvature. The discharge ports 54 are each preferably about 1.5 inches in length and are spaced about 0.375 inches apart. The discharge port nearest the discharge end 52 is preferably spaced about 1.5 inches therefrom.

An end plate (not shown) made of 16 gage steel is connected to the discharge end 52 of the output conduit 46. The end plate has an aperture of preferably about 0.125 inches near its center to relieve some of the pressure created during operation of the heat circulator.

A decoratine panel 56 is provided to overlay the flattened sections 16, 50 and span at least the width of the fireplace opening. A corresponding set of five discharge ports 55 are located within one end of the panel 56 which align with the discharge ports 54 of the output conduit 46. The panel 56 has an aesthetic appearance and conceals the flattened sections 16, 50. A pair of slots 58 are cut into the rear of the panel 56 so that a portion of the flattened sections 16, 50 can extend through the rear of the panel 56 and the panel 56 can rest flat on the hearth extension. The panel 56 is preferably made of 22 gage steel and is about 47 inches long, 2.75 inches deep, and 1.0 inches high.

Figure 2:
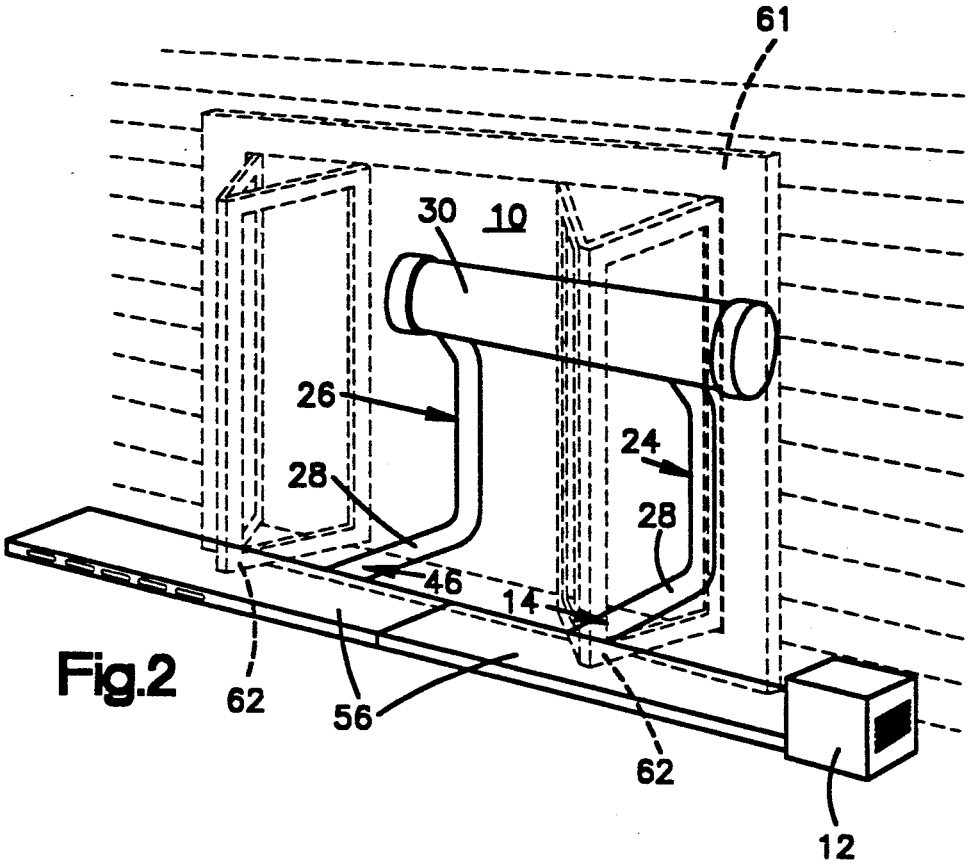
FIG. 2 is a front perspective view of FIG. 1 with the preferred embodiment assembled and integrated with a fireplace.

Referring now to FIG. 2, there is shown a heat exchanger according to the present invention 10 situated within a fireplace having a frame 61 with a pair of glass doors 62. A fireplace grate (not shown) can be placed upon the lower legs 28 of the input and output riser tubes 24, 26, or the grate can be placed between the legs 28, if necessary.

Figure 3:
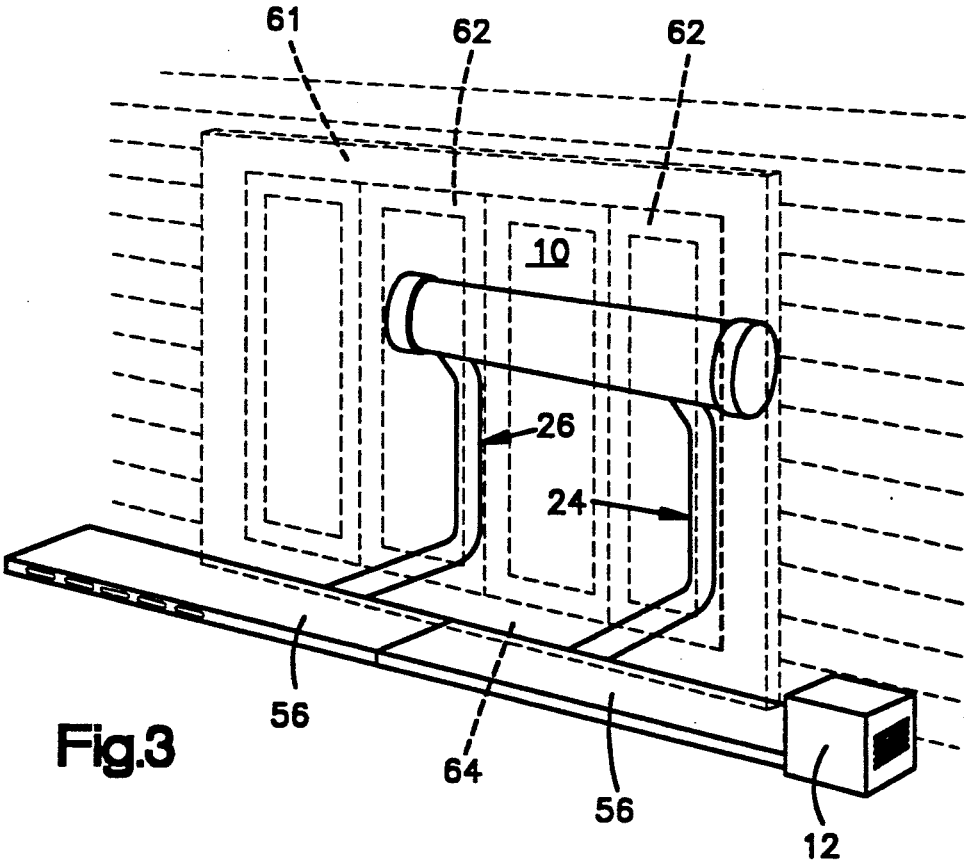
FIG. 3 is a front perspective view of FIG. 2 with the fireplace doors closed.

FIG. 3 depicts a fireplace with the doors 62 closed. The lower segment 64 of the frame 61 rests upon a portion of the panel 56.

The invention and its attendant advantages will be understood from the foregoing description and it will be apparent that various changes may be made in the form, construction and arrangement of the parts without departing from the spirit or scope thereof or sacrificing its material advantages, the arrangement hereinbefore described being merely by way of example and we do not wish to be restricted to the specific form shown or uses mentioned except as defined in the accompanying claims.

What we claim is:

1. In a fireplace heat exchanger including a heat reservoir in which a flow of air sustains an increase in temperature, means for introducing the flow of air into the heat reservoir, means for directing the flow of air from the heat reservoir into a room, telescoping means for adjusting the depth of the heat exchanger, and blower means for forcing the flow of air through the heat exchanger, wherein the heat exchanger is compatible with a fireplace having a frame housing glass doors or the like, the improvement wherein:

said means or introducing the flow of air into the heat reservoir comprises an input conduit having a first end inserted within said blower means and a second end connected to a first end of an input riser tube, a second end of said input riser tube being inserted within a first aperture of said heat reservoir, said input conduit including a flattened section of which a portion is inserted within said blower, a cylindrical mid-section connecting said flattened section to a stepped section having an outside diameter slightly smaller than the inside diameter of said first end of said input riser tube so that said stepped section is slidable within said input riser tube to adjust the depth of said heat exchanger within a fireplace; and said means for directing the flow of air from the heat reservoir into the room comprises an output riser tube having a first end inserted within a second aperture of said heat reservoir and a second end connected to a first end of an output conduit, said output conduit having a second end for discharging the air into the room.

2. A fireplace heat exchanger as recited in claim 1, wherein said output conduit includes a flattened section, a cylindrical mid-section connecting said flattened section to a stepped section having an outside diameter slightly smaller than the inside diameter of said second end of said output riser tube so that said stepped section of said output conduit is slidable within said output riser tube to adjust the depth of said heat exchanger within a fireplace.

3. A fireplace heat exchanger as recited in claim 1, wherein said second end of said output conduit includes at least one port through which air is discharged into a room.

4. A fireplace heat exchanger as recited in claim 3, wherein there are five of said ports.

5. A fireplace heat exchanger as recited in claim 3, wherein said blower means pumps approximately 50 cubic feet of air per minute through said heat exchanger.

6. A fireplace heat exchanger as recited in claim 1, further comprising a panel for overlaying at least a portion of said input conduit and at least a portion of said output conduit extending outside the fireplace, the frame housing the glass doors or the like resting upon said manifold.

7. A fireplace heat exchanger as recited in claim 4, further comprising a panel for overlaying at least a portion of said input conduit and at least a portion of said output conduit extending outside the fireplace, one end portion of said panel including five ports that align with said five ports of said output conduit when said panel is placed over said output conduit, the frame housing the glass doors or the like resting upon said panel.

8. A fireplace heat exchanger as recited in claim 5, wherein said input riser tube and said output riser tube have outside diameter of approximately two inches and are made of 16 gage steel.

9. A fireplace heat exchanger as recited in claim 7, wherein said panel overlays all of those portions of said input conduit and said output conduit extending outside the fireplace and spans the entire width of the fireplace opening, the doors or the like housed within the frame are capable of being opened and closed when said panel is in place.

10. A fireplace heat exchanger as recited in claim 8, wherein said heat reservior is a cylinder approximately 21 inches in length having an inside diameter of approximately four inches and is made of 16 gage steel.

11. A fireplace heat exchanger as recited in claim 10, wherein said input riser tube and said output riser tube each include a leg that rests substantially flat on the fireplace floor, a mid-section extending substantially vertical from said leg, and an upper section extending from said mid-section at an angle of about 45° so that said heat reservoir can be suspended above a fire within the fireplace, said legs being spaced apart so that a fireplace grate can be placed upon each lower leg of said riser tubes, or therebetween.

12. A fireplace heat exchanger as recited in claim 10, wherein said stepped portions of said input and output conduits have an outside diameter of between about 1.84 and 1.85 inches and are made of 16 gage steel.

13. A fireplace heat exchanger as recited in claim 4, wherein each discharge port is substantially rectangular having a radius of curvature defining each end, said discharge ports being about 1.5 inches in length and being spaced about 0.375 inches apart.

14. A fireplace heat exchanger as recited in claim 7, wherein said panel is about 47 inches long, about 2.75 inches deep, and about 1.0 inches high.

* * * * *

UNITED STATES PATENT AND TRADEMARK OFFICE

CERTIFICATE OF CORRECTION

PATENT NO. : 5,139,012

DATED : August 18, 1992

INVENTOR(S) : Arthur J. Furman, et al.

It is certified that error appears in the above-identified patent and that said Letters Patent is hereby corrected as shown below:

Column 1, line 29, "fireplaces" should be --fireplace--.

Column 1, line 31, "fireplaces" should be --fireplace--.

Column 1, line 58, "conversion" should be --convection--.

Column 3, line 6, after "durable" insert --,--.

Column 3, line 6, "nd" should be --and--.

Column 3, line 7, "frame" should be --frames--.

Column 3, line 42, "thay" should be --they--.

Column 3, line 62, "director" should be --direct--.

Column 3, line 18, "circular" should be --circulator--.

Column 4, line 18, "earier" should be --easier--.

Column 4, line 29, "first" should be --front--.

Column 4, line 30, after "the" insert --present--.

Column 5, line 25, "ouput" should be --output--.

Column 5, line 63, "decoratine" should be --decorative--.

Column 6, line 40, "or" should be --for--.

UNITED STATES PATENT AND TRADEMARK OFFICE

CERTIFICATE OF CORRECTION

PATENT NO. : 5,139,012

DATED : August 18, 1992

INVENTOR(S) : Arthur J. Furman, et al

It is certified that error appears in the above-indentified patent and that said Letters Patent is hereby corrected as shown below:

Column 7, line 30, "diameter" should be --diameters--.

Signed and Sealed this

Seventh Day of September, 1993

Bruce Lehman

*Attest:*

BRUCE LEHMAN

*Attesting Officer*

*Commissioner of Patents and Trademarks*